US006076245A

United States Patent [19]

Sutter

[11] Patent Number: 6,076,245

[45] Date of Patent: Jun. 20, 2000

[54] METHOD OF ASSEMBLING A GOLF CLUB ORGANIZING ASSEMBLY

[75] Inventor: James L. Sutter, Evergreen, Colo.

[73] Assignee: Great Divider Golf, Inc., Golden, Colo.

[21] Appl. No.: 09/232,050

[22] Filed: Jan. 15, 1999

Related U.S. Application Data

[60] Division of application No. 08/917,431, Aug. 19, 1997, Pat. No. 5,871,093, which is a continuation-in-part of application No. 08/710,866, Sep. 23, 1996, Pat. No. 5,671,843.

[51] Int. Cl.[7] ..... B21D 39/03; B23P 11/00

[52] U.S. Cl. ..... 29/428; 206/315.3; 206/315.6; 150/112

[58] Field of Search ..... 29/428; 206/315.3, 206/315.5, 315.6; 190/109, 110, 111, 112; 150/112, 113, 114, 115

[56] References Cited

U.S. PATENT DOCUMENTS

| | | | |
|---|---|---|---|
| 1,754,541 | 4/1930 | Benoit . | |
| 1,798,638 | 3/1931 | Stone et al. . | |
| 2,568,810 | 9/1951 | Kish, Jr. | 150/1.5 |
| 2,874,813 | 2/1959 | Bunte | 190/51 |
| 3,331,419 | 7/1967 | Bencriscutto | 150/1.5 |
| 4,172,484 | 10/1979 | Henning | 150/1.5 B |
| 4,311,178 | 1/1982 | Kennedy | 150/1.5 R |
| 4,544,092 | 10/1985 | Palmer | 229/15 |
| 4,596,328 | 6/1986 | Solheim | 206/315.6 |
| 4,610,286 | 9/1986 | Cyr | 150/52 J |
| 4,691,823 | 9/1987 | Pape | 206/315.6 |
| 4,753,344 | 6/1988 | Antonious | 206/315.3 |
| 4,768,650 | 9/1988 | Chancellor, Jr. | 206/315.3 |
| 4,844,253 | 7/1989 | Reimers | 206/315.6 |
| 5,123,531 | 6/1992 | Beretta | 206/315.3 |
| 5,125,507 | 6/1992 | Graziano, Jr. | 206/315.6 |
| 5,392,907 | 2/1995 | Blanchard et al. | 206/315.6 |
| 5,421,454 | 6/1995 | Chuern | 206/315.6 |
| 5,431,278 | 7/1995 | Gretz | 206/315.6 |
| 5,447,228 | 9/1995 | Hodgson, III | 206/315.3 |
| 5,450,958 | 9/1995 | Shin | 206/315.6 |
| 5,474,176 | 12/1995 | Schenkkan | 206/315.7 |
| 5,501,328 | 3/1996 | Keller et al. | 206/315.6 |
| 5,518,113 | 5/1996 | Boone | 206/315.6 |
| 5,573,112 | 11/1996 | Kim | 206/315.6 |

FOREIGN PATENT DOCUMENTS

| | | | |
|---|---|---|---|
| 2130102 | 5/1984 | United Kingdom | 206/315.6 |

*Primary Examiner*—David P. Bryant
*Assistant Examiner*—Jermie E. Cozart
*Attorney, Agent, or Firm*—Flanagan & Flanagan; John R. Flanagan; John K. Flanagan

[57] ABSTRACT

A golf club organizing assembly includes divider members having upper and lower longitudinal edges and respective slits and notches defined through the divider members between their upper and lower longitudinal edges for intersecting and interfitting the divider members with and through one another so as to form a plurality of slots for receiving the shafts of golf clubs placed in a carrying bag. The slits are defined through first divider members and the notches are defined through second divider members. The slits in the first divider members have upper and lower ends inwardly spaced from the upper and lower longitudinal edges of the first divider members leaving upper and lower portions of the first divider members extending between the upper and lower longitudinal edges of the first divider members and upper and lower ends of the slits. The notches in the second divider members extend from one of the longitudinal edges of the second divider members to inner ends spaced inwardly from the other of the longitudinal edges of the second divider members. The second divider members are fitted through the slits in the first divider members with the notches of the second divider members interlocked with respective portions of the first divider members adjacent to the slits therein.

13 Claims, 5 Drawing Sheets

FIG. 13
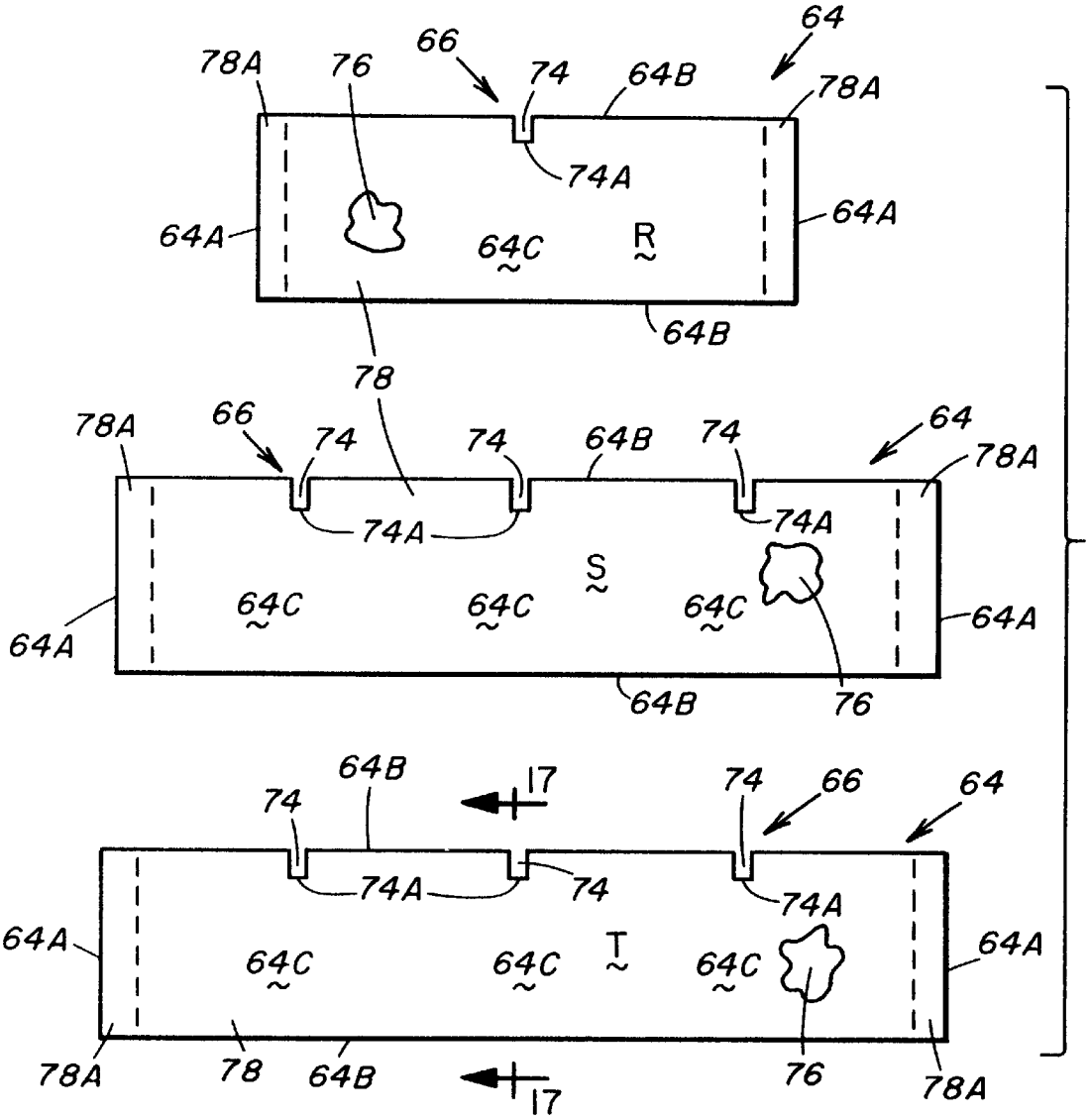
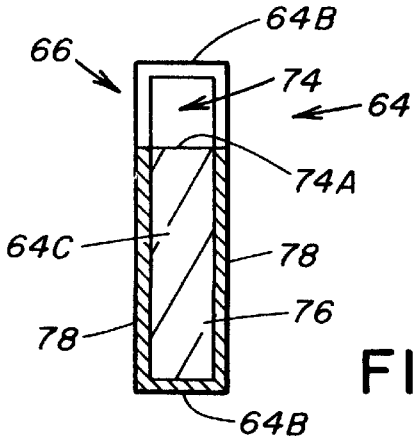
FIG. 17

METHOD OF ASSEMBLING A GOLF CLUB ORGANIZING ASSEMBLY

This application is a divsion of application Ser. No. 08/917,431, filed Aug. 19, 1997 now U.S Pat. No. 5,871, 093, which is a continuation-in-part of patent application Ser. No. 08/710,866, filed Sep. 23, 1996, now U.S. Pat. No. 5,671,843.

BACKGROUND OF THE INVENTION

1. Field of the Invention

The present invention generally relates to arranging golf clubs in carrying bags and, more particularly, is concerned with a golf club organizing assembly and method of assembling the same.

2. Description of the Prior Art

Golf clubs are often carried in a sleeve-like bag designed for that purpose. As seen in a top plan view in FIG. 1 and in a side elevational view in FIG. 2, a basic prior art golf club carrying bag 10 has a tubular sidewall 12 open at an upper end 12A and closed at a lower end 12B by a bottom end wall 14. An interior of the bag 10 defines a cavity 16 in which the golf clubs are stored vertically with their handgrip ends down so that the heads of the clubs extend above the open upper end 12A of the bag 10.

As is well-known, golf clubs generally differ from one another in terms of lengths of their shafts, shapes and sizes of their heads, and angles at which their golf ball striking surfaces extend relative to a horizontal plane. Golfers select one of the clubs to use for any given stroke depending on the particular placement of the ball whether in the rough or on the tee, fairway or green and the distance of the ball from the hole. As a result, many golfers prefer to maintain their clubs in their bag in some organized fashion so that they can quickly locate and replace the one club they have selected to use for the particular stroke at hand.

The basic design of the prior art golf bag 10, shown in FIGS. 1 and 2, does not provide a means to organize the clubs in the bag 10. As the bag 10 is moved and jostled about during a round of play, the clubs will bump each other and move around in the bag 10 relative to one another and will be disorganized causing the golfer to constantly search for the selected club. The bumping of the clubs against one another may also result in wear on the handgrip surfaces and dings and nicks on the club heads. In an effort to address these problems with the basic prior art bag 10, a variety of prior art approaches to bag design for better arranging and organizing golf clubs in the bags have occurred over the years.

In a first prior art approach, as shown in a top plan view in FIG. 3, the bag 10 at the open upper end is provided with a front-to-back extending rigid central bar 18 and a pair of front-to-back spaced apart rigid cross bars 20, 22. The bars 18 to 22 are fixedly attached at opposite ends to the upper end 12A of the bag sidewall 12. In some cases, divider panels of cloth or plastic sheets are also provided, being attached to and extending downward from the cross bars 20, 22 to the bottom wall 14 of the bag 10 forming three separate compartments. These bars 20, 22 and panels serve to spread and separate groups of clubs from one another. Nevertheless, clubs within a group can still move around and bump one another such that they remain substantially disorganized and subject to damaging contacts.

In a second prior art approach, as shown in a top plan view in FIG. 4, a plurality of plastic elongated tubes 24, each for receiving one of the clubs, are inserted in the club carrying cavity 16 of the bag 10 and arranged in a side-by-side relation substantially filling the cavity 16. While the tubes 24 will generally maintain the clubs in a desired organized arrangement, they may scuff and wear the handgrips and over time tend to bend and split from golfers repeatedly inserting and pulling out the clubs at various angles relative to the tubes 24. Also, the tubes 24 will frequently be pulled out of the bag 10 with the clubs.

In a third prior art approach, as shown in a top plan view in FIG. 5, the bag 10 is provided with a plurality of peripheral elongated compartments 26 formed about the inside perimeter of the bag sidewall 12 by a large flexible panel 28 which is arranged in a serpentine configuration to define side-by-side, bell-shaped wall portions 30 projecting from the sidewall 12 of the bag 10 toward the center of the bag 10 and attached to the bag sidewall 12 along narrow portions 32 of the flexible panel 28 which extends between the bell-shaped wall portions 30. This approach also has two separate panel pieces 34 attached at their opposite vertical edges to the bag sidewall 12 and extending across the cavity 16 of the bag 10 defining four central elongated compartments 36 for receiving golf clubs and other accessories such as a ball retriever and/or an umbrella. A representative example of this approach is a golf club organizer product sold under a U.S. registered trademark "Crospete". While the compartments 26 will maintain clubs in an organized arrangement, they have a relatively tight fit creating difficulty in removing and returning the clubs from and back to the compartments 26 and causing increased wear to both handgrips and the wall portions 30 which may result in premature deterioration thereof. Furthermore, the peripheral arrangement of the compartments 26 provides a fixed pattern which bears no logical relationship to how most golfers would desire to organize their clubs in the bag.

Consequently, a need remains for an organizing assembly for arranging golf clubs in a carrying bag and a method of assembling the organizing assembly which provides a solution to the aforementioned problems in the prior art without introducing any new problems in place thereof.

SUMMARY OF THE INVENTION

The present invention provides a golf club organizing assembly and method of assembling the same which are designed to satisfy the aforementioned need. The golf club organizing assembly and method of assembling the same provides a first plurality of divider members, such as straight members, and a second plurality of divider members, such as curved members, intersecting and interfitted with and through one another so as to create a plurality of slots for receiving the shafts of golf clubs in a carrying bag. A principal advantage of the curved members over the straight members is that the curved members provide more equalization in the process of forming the slots and dividing up the available storage volume of the bag. The arrangement of the slots in relation to one another also minimizes contact between adjacent clubs and thereby reduces the wear on the handgrips and number of dings and nicks on the club heads. The provision of slits and notches in the respective first and second pluralities of divider members to enable intersecting and interfitting thereof with and through one another together with attachment of their opposite ends to spaced portions of a round member either separate or integral with the top open end of the bag ensures that the divider members are held and retained in the desired configuration providing the preferred arrangment of the organizing slots.

Accordingly, the present invention is directed to a golf club organizing assembly which comprises a first plurality of divider members having a pair of opposite ends and opposite spaced upper and lower longitudinal edges extending between the opposite ends; and a second plurality of divider members having a pair of opposite ends and opposite spaced upper and lower longitudinal edges extending between the opposite ends. The divider members of the first and second pluralities have aperture means defined through portions of the divider member located between the upper and lower longitudinal edges thereof for interfitting the divider members of the first plurality through the divider members of the second plurality in an intersecting relationship so as to form a plurality of slots between the divider members of the first and second pluralities for receiving shafts of golf clubs placed in the carrying bag.

More particularly, the aperture means include slits defined through the divider members of the first plurality and notches defined through the divider members of the second plurality. The slits in the divider members of the first plurality have opposite upper and lower ends which are inwardly spaced from the opposite upper and lower longitudinal edges of the divider members so as to leave upper and lower portions of the divider members extending between the opposite upper and lower longitudinal edges of the divider members and the opposite upper and lower ends of the slits. The notches in the divider members of the second plurality extend from one of the opposite upper and lower edges of the divider members to inner ends terminating in spaced relationship inwardly from the other of the opposite upper and lower longitudinal edges of the divider members so as to leave portions of the divider members extending between the inner ends of the notches and the other of the opposite upper and lower longitudinal edges of the divider members.

The organizing assembly further includes a round member attachable to and retrofitable at the open upper end of the carrying bag such that the divider members of the first and second pluralities are attached at their opposite ends to and extend between first and second spaced portions of the round member and are not directly attached to the open upper end of the bag. The assembly may alternatively be an integral part of the carrying bag where the divider members are attached at their opposite ends to and extend between first and second spaced portions of a round member which is an integral part of the open upper end of the bag.

The present invention also is directed to a method of assembling a golf club organizing assembly for use in receiving golf clubs in a carrying bag. The assembling method comprises the steps of providing first and second pluralities of divider members, each divider member having a pair of opposite ends and opposite spaced upper and lower longitudinal edges, the divider members having apertures defined through portions of the divider members located between the upper and lower longitudinal edges thereof, and interfitting the divider members of the first and second pluralities with one another in an intersecting relationship at the apertures in the portions thereof so as to form a plurality of slots for receiving shafts of golf clubs placed in the carrying bag. The assembling method further comprises the steps of extending the divider members of the first and second pluralities between respective first and second spaced portions of an open upper end of the carrying bag and interconnecting the opposite ends of the divider members of the first and second pluralities to the respective first and second spaced portions of the open end of the carrying bag or of a round member which fits within the open end of the carrying bag. The dividers members of the first plurality are interconnected between the first spaced portions of the open end of the carrying bag or of the round member so as to have substantially straight configurations while the divider members of the second plurality are interconnected between the second spaced portions of the open end of the carrying bag or of the round member so as to have substantially curved configurations.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 13 is a plan view of the divider members of the second plurality in the organizing assembly of FIG. 11 having notches formed therein.

FIG. 17 is an enlarged cross-sectional view taken along line 17—17 of FIG. 13.

DETAILED DESCRIPTION OF THE INVENTION

Figure 1:
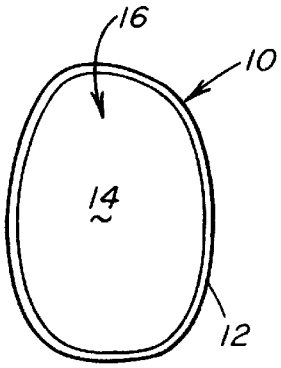
FIG. 1 (PRIOR ART)
FIG. 1 is a top plan view of a prior art golf bag having a basic design as described earlier.
Figure 3:
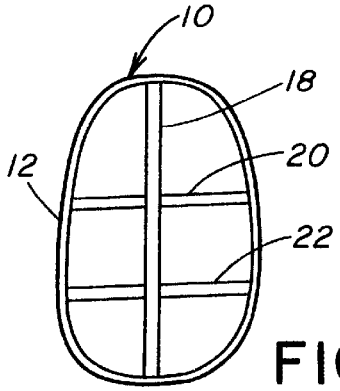
FIG. 3 (PRIOR ART)
FIG. 3 is a top plan view of the first prior art approach for arranging clubs in a golf bag as described earlier.
Figure 4:
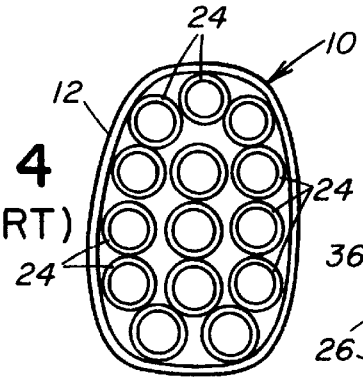
FIG. 4 (PRIOR ART)
FIG. 4 is a top plan view of the second prior art approach for arranging clubs in a golf bag as described earlier.
Figure 5:
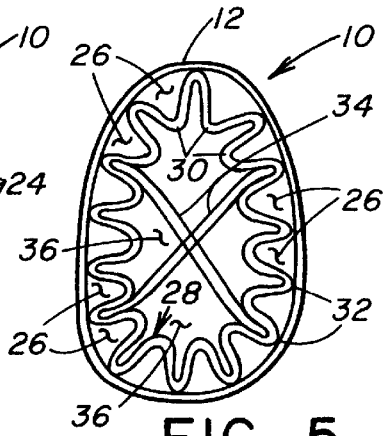
FIG. 5 (PRIOR ART)
FIG. 5 is a top plan view of the third prior art approach for arranging clubs in a golf bag as described earlier.
Figure 2:
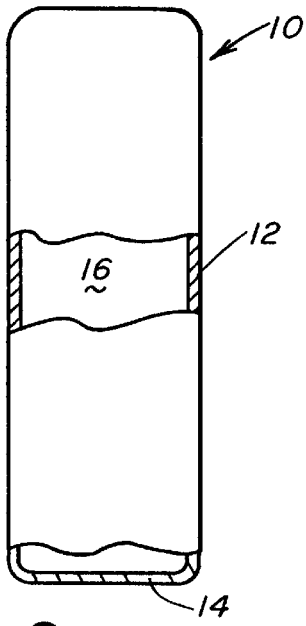
FIG. 2 (PRIOR ART)
FIG. 2 is a side elevational view of the prior art golf bag shown in FIG. 1 with portion of its sidewall broken away.

Referring to the drawings and particularly to FIGS. 6 to 9, there is diagrammatically illustrated a golf club organizing assembly, generally designated 40, of the invention of the copending parent application as it would be provided in a conventional golf club carrying bag 10. As described earlier in the background of the invention and shown in FIGS. 1 and 2, the golf bag 10 has the tubular sidewall 12 open at the upper end and closed at the lower end by the bottom end wall 14. The interior of the bag 10 defines the cavity 16 in which the golf clubs are stored vertically with their handgrip ends down so that the heads of the clubs extend above the open upper end of the bag 10.

The golf club organizing assembly 40 defines an array or arrangement of locations for receiving clubs in the golf bag 10 which are designed to shape and distribute the storage space available in the golf bag 10 in a manner which bears a direct logical relationship to how most golfers would desire to organize their clubs in the bag. The arrangement of clubs by the assembly 40 also minimizes contact between adjacent clubs and thereby reduces the wear on the handgrips and number of dings and nicks on the club heads.

Basically, the golf club organizing assembly 40 includes a plurality of relatively (or approximately) straight divider members 42 and relatively (or approximately) curved divider members 44 for attachment to the golf club carrying bag 10. The straight members 42 are interconnected at opposite ends 42A, 42B to and extend between spaced front and rear portions of the open upper end of the sidewall 12 of the bag 10. The curved members 44 are interconnected at opposite ends 44A, 44B to and extend between spaced opposite side portions of the open upper end of the sidewall 12 of the bag 10. The curved members 44 cross the straight members 42 and together define a plurality of slots 46 defining the aforementioned array of locations for receiving therethrough the shafts of golf clubs in the bag 10. Including curved members 44 instead of only all straight members 42 in forming the slots 46 in the bag 10 provides more effective shaping, division and distribution and thus equalization of the available storage space or volume of the bag 10 for receiving the various clubs therein.

Figure 6:
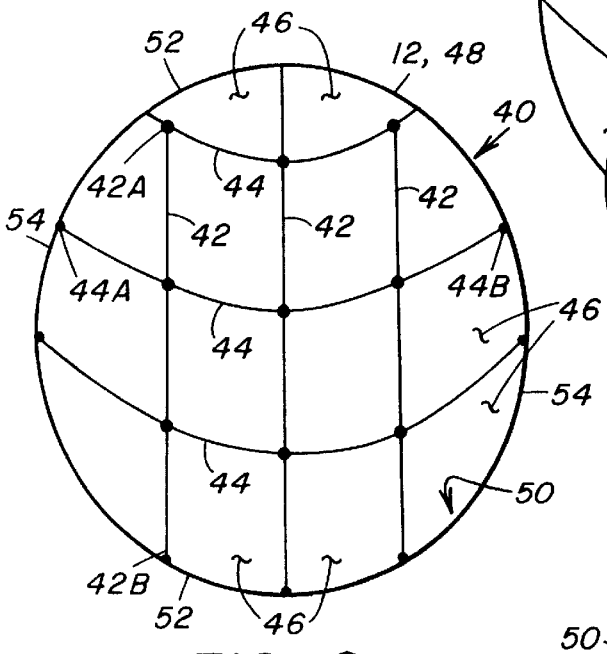
FIG. 6 is a diagrammatic top plan view of a first configuration of the golf club organizing assembly of the invention of the copending parent application.
Figure 7:
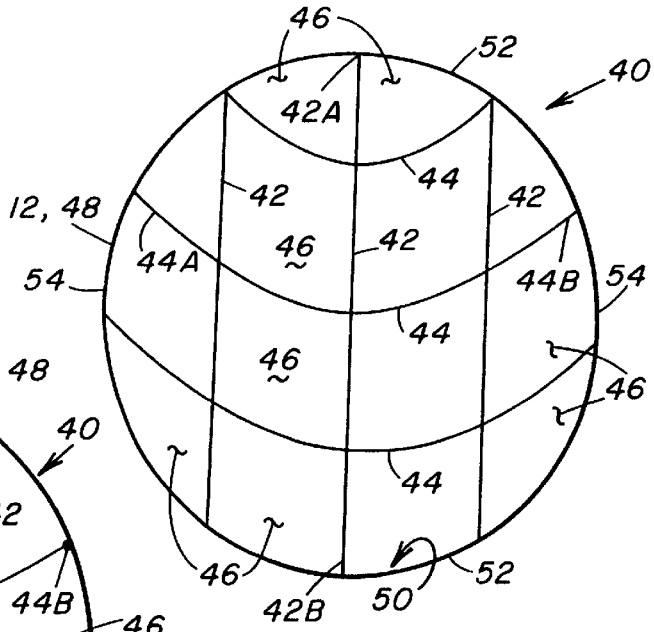
FIG. 7 is a diagrammatic top plan view of a second configuration of the organizing assembly of the copending parent application.
Figure 9:
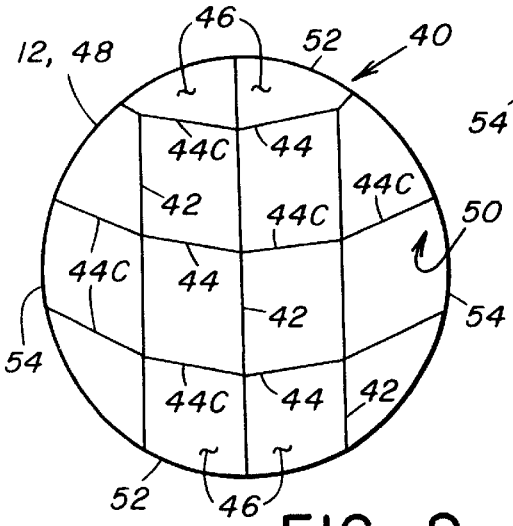
FIG. 9 is a diagrammatic top plan view of a fourth configuration of the organizing assembly of the copending parent application.
Figure 8:
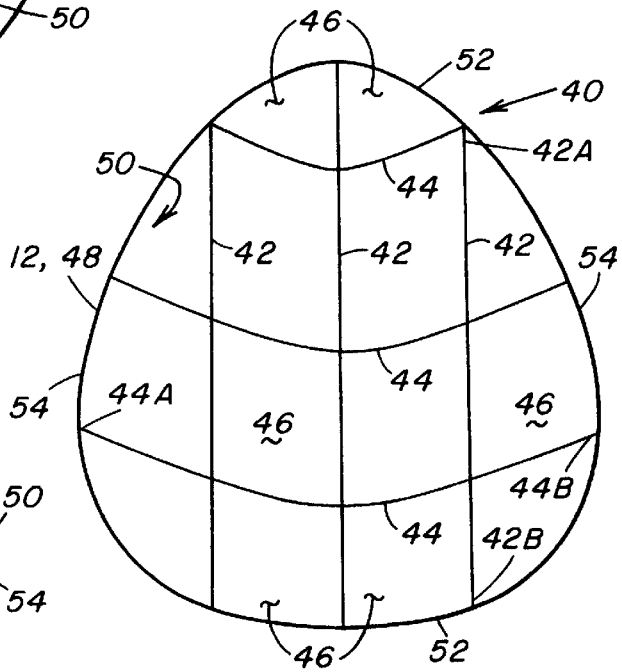
FIG. 8 is a diagrammatic top plan view of a third configuration of the organizing assembly of the copending parent application.

The straight members 42 and the curved members 44 each are preferably three in number and form fourteen slots 46, though the straight and curved members 42, 44 can be provided in other suitable numbers and form other suitable numbers of slots 46. Each slot 46 is intended to receive one golf club. The straight members 42 are disposed in substantially parallel relation to one another. The curved members 44 are disposed in substantially concentric relation to one another. As shown in FIGS. 6 to 9, the straight and curved members 42, 44 can be provided in different configurations being slightly modified from one another. FIG. 6 depicts the outer two straight members 42 interconnected to the sidewall 12 via connection at their forward ends to the forward one of the curved members 44, whereas FIG. 7 depicts the outer two straight members 42 along with the opposite ends of the forward curved member 44 attached directly to the sidewall 12 of the bag 10. FIG. 8 depicts the curved members 44 having a generally chevron or shallow V shape whereas FIG. 9 depicts the curved members 44 made up of an overall curved arrangement of straight interconnected segments 44C.

The straight and curved members 42, 44 are preferably comprised of a substantially semi-flexible material but can be of any other suitable material. Also, the members 42, 44 are preferably covered by a soft fabric material but need not be and can be covered by any other suitable material.

The golf club organizing assembly 40 can further include a continuous round member 48 attachable to and retrofitable at the open upper end 12A of the sidewall 12 of the bag 10. The round member 48 encircles a space 50 and has pairs of first and second circumferentially and oppositely spaced portions 52, 54. In this embodiment, the straight members 42 are disposed in the space 50 of the round member 48 and are attached at opposite ends 42A, 42B to and extend between the first opposite spaced portions 52 of the round member 48. The curved members 44 are also disposed in the space 50 of the round member 48 and are attached at opposite ends 44A, 44B to and extend between the second opposite spaced portions 54 of the round member 48. The first spaced portions 52 of the round member 48 are located at the front and back of the open upper end 12A of the sidewall 12 of the bag 10 with reference to a shoulder strap (not shown) attached at the back thereof. The second spaced portions 54 of the round member 48 are located at sides of the open upper end 12A of the bag 10 with reference to the shoulder strap. The golf club organizing assembly 40 may also be an integral part of the bag 10 where the straight and curved members 42, 44 are attached at their opposite ends to and extend between the aforementioned spaced portions of the round member 48 which can be an integral part of the open upper end of the bag sidewall 12.

Furthermore, the straight and curved members 42, 44 can each be in the form of a strap having a length extending transversely across the open upper end of the sidewall 12 of the bag 10, a depth extending longitudinally in the cavity 16 of the bag 10, and a thickness extending between opposite surfaces on the members. The length of each member 42, 44 is greater than the depth thereof. The depth of each member 42, 44 is greater than the thickness thereof. Each straight and curved member 42, 44, or any one or more thereof, may also be in the form of a cylindrical elongated rod having a diameter and a length extending transversely across the open upper end of the bag 10 greater than the diameter thereof. Each straight and curved member 42, 44 may also have any other suitable configuration. The straight and curved members 42, 44 may also extend above or below one another or may be secured to one another by any suitable means. By way of example, the straight and curved member 42, 44 may intersect one another by one of them passing through a slit in the other and being stitched together at their points of intersection. Any one or more of the straight and curved members 42, 44 may also be removable.

Figure 10:
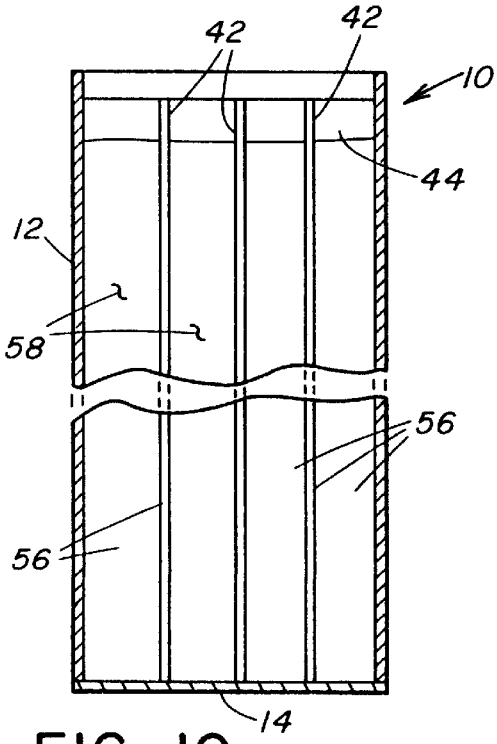
FIG. 10 is a foreshortened partially sectional side elevational view of the golf bag showing divider panels employed in the bag with the organizing assembly.

Referring now to FIG. 10, one or more of the straight and curved members 42, 44 may be employed with at least one and preferably a plurality of vertical dividers 56 disposed and extending between the open upper end of the sidewall 12 of the carrying bag 10 and the bottom wall 14 of the bag 10 so as to provide full-length slots 58 for receiving golf clubs in the bag 10. The vertical dividers 56 may be comprised of a substantially semi-flexible material but can be of any other suitable material and is covered by a soft fabric material but need not be and can be covered by any other suitable material and may be removable.

Referring now to FIGS. 11–17, there is illustrated another embodiment of a golf club organizing assembly constituting the present invention, generally designated 60, made in accordance with an assembling method of the present invention. The organizing assembly 60 includes first and second pluralities of divider members 62, 64 (hereinafter for the sake of brevity referred to as first and second divider members 62, 64) having opposite ends 62A, 64A and opposite spaced upper and lower longitudinal edges 62B, 64B, and aperture means 66 defined through the first and second divider members 62, 64 respectively. The aperture means 66 are located between the upper and lower longitudinal edges 62B, 64B of the respective first and second divider members 62, 64 for enabling the interfitting and interlocking of portions of the first and second divider members 62, 64 through and with one another in an intersecting relationship so as to form a plurality of slots 68 in the organizing assembly 60 for receiving the shafts of golf clubs in the golf club carrying bag.

Further, the organizing assembly 60 includes a substantially round member 70 (which can have various round shapes some examples of which are shown in FIGS. 6–9 and 11) attachable to and retrofitable at the open upper end of the carrying bag such that the first and second divider members 62, 64 are attached, such as by stitching, at their opposite ends 62A, 64A to and extend between first spaced portions 70A and second spaced portions 70B of the round member 70 and are not directly attached to the open upper end of the bag. The organizing assembly 60 can alternatively be an integral part of the carrying bag where the round member 70 is an integral part of the open upper end of the bag. The first divider members 62 preferably, but within the principles of the present invention not necessarily, are attached at their opposite ends 62A so as to have substantially straight configurations. The second divider members 64 preferably, but within the principles of the present invention not necessarily, are attached at their opposite ends 64A so as to have substantially curved configurations.

More particularly, the aperture means 66 of the organizing assembly 60 preferably takes the form of narrow openings in the form of slots or slits 72 defined through the first divider members 62 and notches 74 defined through the second divider members 64. The slits 72 are spaced longitudinally from one another between the opposite ends 62A of each first divider member 62. Except for one second divider member 64 which may have only one notch 74, the notches 74 in the other second divider members 64 are longitudinally spaced from one another between the opposite ends 64A of the other second divider members 64. Each slit 72 has opposite upper and lower ends 72A which are inwardly (respectively downwardly and upwardly) spaced from the upper and lower longitudinal edges 62B of the respective first divider member 62 so as to leave solid upper and lower portions 62C of the first divider members 62 extending between the upper and lower longitudinal edges 62B thereof and the respective upper and lower ends 72A of the slits 72. Each notch 74 extends from the upper longitudinal edge 64B of the respective second divider member 64 downward to an inner end 74A of the respective notch 74 terminating in spaced relationship above or inwardly from the lower longitudinal edge 64B of the respective second divider member 64 so as to leave a solid portion 64C thereof extending between the inner end 74A of the respective notch 74 and the lower longitudinal edge 64B of the respective second divider member 64. The second divider members 64 intersect and cross the first divider members 62 by extending through the slits 72 therein and together form the plurality of slots 68 for receiving therethrough the golf clubs into the carrying bag. The second divider members 64 are interlocked with the first divider members 62 by the notches 74 in the second divider members 64 receiving the upper portions 62C of the first divider members 62 which extend between the upper longitudinal edges 62B of the first divider members 62 and the upper ends 72A of the slits 72.

As more particularly shown in FIGS. 14–17, each of the first and second divider members 62, 64 preferably has an elongated inner flat strip 76 with the material making up the strip 76 being sufficiently semi-rigid and semi-flexible, such as a suitable plastic, that it will retain its desired shape. Each first and second divider member 62, 64 also preferably has an elongated outer protective covering strip 78 substantially enclosing each of the inner strips 76 so as to protect the shafts of the golf clubs and to provide an attractive appearance to the organizing assembly 60. The slits 72 and notches 74 extend through both the inner strips 76 and the outer protective covering strip 78 of the respective first and second divider members 62, 64.

Figure 11:
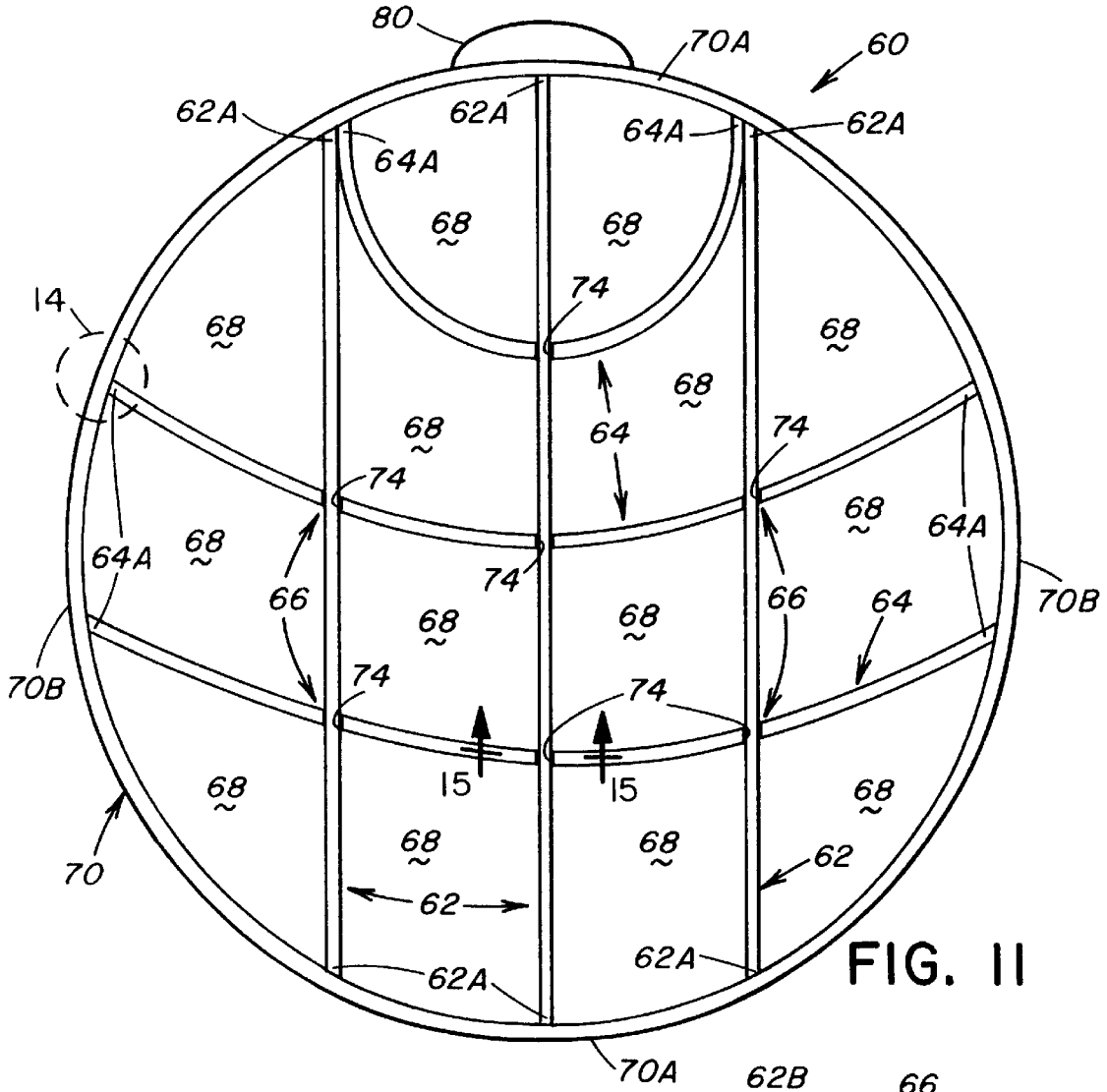
FIG. 11 is a top plan view of the golf club organizing assembly of the present invention having first and second pluralities of divider members intersecting and interfitted with and through one another in accordance with an assembling method of present invention.
Figure 14:
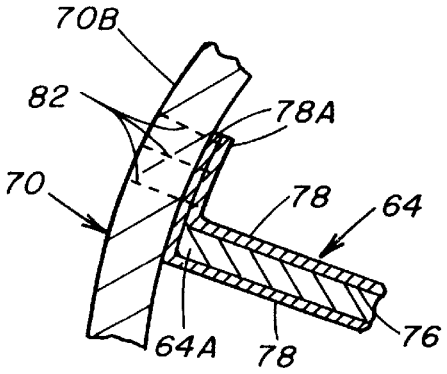
FIG. 14 is an enlarged detailed view of the portion of the organizing assembly enclosed by circle 14 of FIG. 11.
Figure 15:
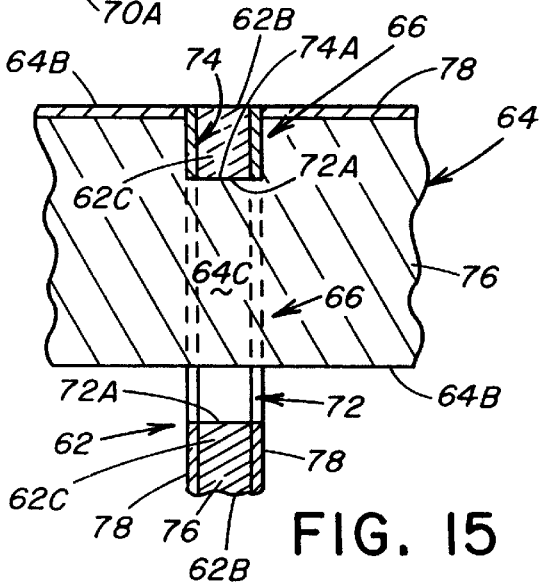
FIG. 15 is an enlarged cross-sectional view taken along line 15—15 of FIG. 11.
Figure 12:
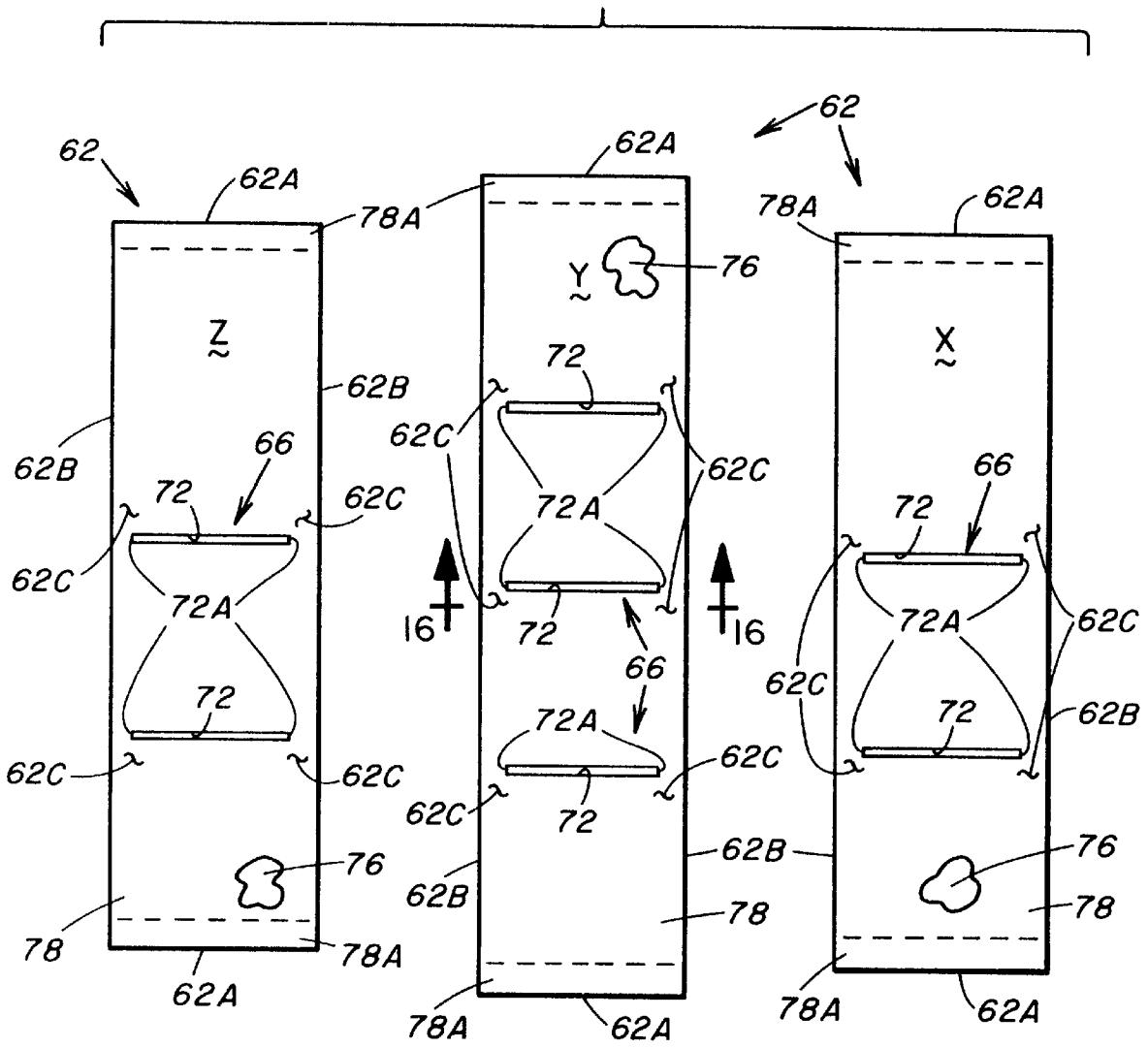
FIG. 12 is a plan view of the divider members of the first plurality in the organizing assembly of FIG. 11 having slits formed therein.
Figure 16:
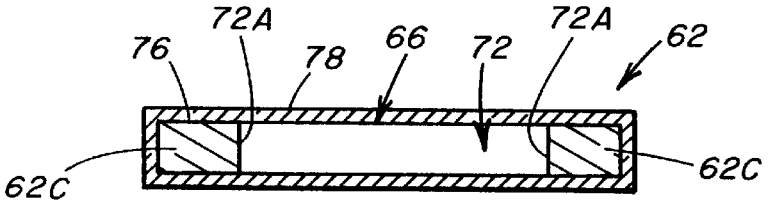
FIG. 16 is an enlarged cross-sectional view taken along line 16—16 of FIG. 12.

As best seen in FIGS. 11–13, in a representative example of the organizing assembly 60 there are three first divider members 62 which for the purposes of clarity can also be referred to as "longitudinal" divider members 62 in the sense that they extend from front to back of the bag (the loop 80 being the reference point representing a bag carrying strap which is located at the front of the bag) and there are three second divider members 64 which for the purposes of clarity can also be referred to as "cross" divider members 64 in the sense that they extend from side to side of the bag. Further, given their relative positions as seen in FIGS. 11 and 12, the longitudinal divider members 62 further can be distinguished from one another by identifying them individually as right, center and left longitudinal divider members X, Y and Z. Also, given their relative positions as seen in FIGS. 11 and 13, the cross divider members 64 further can be distinguished from one another by identifying them individually as front, center and rear cross divider members R, S and T.

In the aforementioned representative example of the organizing assembly 60 for a 8½ inch diameter golf club carrying bag, the longitudinal and cross divider members 62, 64 and the slits and notches 72, 74 can have the following specifications. The inner strip 76 of each longitudinal and cross divider member X, Y, Z and R, S, T is preferably flat and rectangular in shape and about 1/16 inch in thickness. The outer covering strip 78 of each longitudinal and cross divider member X, Y, Z and R, S, T is a flexible sheet of cloth material preferably rectangular in shape and has an adhesive backing to keep the covering strip 78 in place on the inner strip 76. One example of a suitable covering material is nylex with a 1/16 inch neoprene backing. The protective covering strips 78 should extend about ½ inch beyond the opposite ends 62A, 64A of the first and second divider members 62, 64 as defined by the opposite ends of the inner strips 76. The excess ½ inch length portion at the opposite end portions 78A of the covering strips 78 is sewn to the round member 70 or open upper end of the bag directly. Each of the first and second divider members 62, 64 may also have flexible nylon pieces sewn to the protective covering strips 78 and extending down to the bottom of the bag and sewn together along their lengths to create full length individual pockets extending from the slots 68.

As seen in FIGS. 11 and 12, the lengths of the inner strips 76 of the right, center and left longitudinal divider members X, Y and Z can be 6¾ 7⅝, and 6¾ inches, respectively. The heights of the inner strips 76 of the right, center and left longitudinal divider members X, Y, Z are each 2 inches. The length of each slit 72 in the inner strips 76 and outer covering strips 78 forming each longitudinal divider member X, Y, Z is 1½ inches and its width is 1/16 inch. The opposite ends 72A of each slit 72 is located about ¼ inch from the corresponding longitudinal edge 62B of the respective divider member 62. With respect to the center longitudinal divider member Y and as measured from the front end 62A reawardly to the front edge of each respective slit 74, the front slit 74 is located at 2⅛ inches, the center slit 74 is located at 3¾ inches, and the rear slit 74 is located at 5½ inches. With respect to each of the right and left (identical) longitudinal divider member X, Z and as measured from the front end 62A rearwardly to the front edge of each respective slit 74, the front slit 74 is located at 2⅞ inches and the rear slit 74 is located at 4¾ inches.

As seen in FIGS. 11 and 13, the lengths of the inner strips 76 of the front, center and rear cross divider members R, S and T are 5¼, 7½ and 7¾ inches, respectively. The heights of the inner strips 76 of the front, center and rear cross divider members R, S and T are each 1½ inches. The depth of each notch 74 is ¼ inch and the width of each notch 74 is ⅛ inch in the inner strips 76 and outer covering strips 78 forming each cross divider member R, S, T.

The method of assembling the organizing assembly 60 for use in receiving golf clubs in a carrying bag basically involves the providing of the first and second divider members 62, 64 as defined above and interfitting the divider members 62, 64 of the first and second pluralities with one another in an intersecting relationship at the slits 72 and notches 74 therein so as to form the plurality of slots 68 for receiving shafts of golf clubs placed in the carrying bag. The divider members 62, 64 are then extended between the respective first and second spaced portions 70A, 70B of the open upper end of the carrying bag or of the round member 70, and the opposite ends 62A, 64A of the first and second divider members 62, 64 are attached to the first and second spaced portions 70A, 70B of the open end of the carrying bag or of the round member 70. It is within the purview of the present invention that the first divider member 62 can be suitably interconnected between the first spaced portions 70A of the open end of the carrying bag or of the round member 70 so as to have substantially straight or other desired configurations whereas the second divider members 64 can be suitably interconnected between the second spaced portions 70B of the open end of the carrying bag or of the round member 70 so as to have substantially curved or other desired configurations. It is also understood to be within the purview of the present invention that any desired configuration of the first and second divider members 62, 64 of the assembly 60 can be provided by attaching the first and second divider members 62, 64 along the appropriate portions of the open end of the bag or of the round member 70 and also by forming the slits 72 and notches 74 defining where the first and second divider member 62, 64 interfit with one another at the appropriate spacings along the divider members 62, 64 that will achieve the desired configuration.

Furthermore in the assembling method the first and second divider members 62, 64 are formed by providing the elongated inner flat strip 76 of the material selected to be sufficiently semi-rigid and semi-flexible to retain its shape and then enclosing the inner strip 76 with the elongated outer protective covering strip 78 of suitably flexible material. The inner strips 76 of the first and second divider members 62, 64 are made in accordance with any generally known manufacturing technique to contain the respective slits 72 and notches 74. Also, suitable cuts are made in the outer covering strip 78 so as to expose the slits 72 and notches 74 in the inner strips 76 so that they extend through both the inner strips 76 and outer protective covering strips 78 of the respective first and second divider members 62, 64. The opposite end portions 78A of the outer covering strips 78 which extend beyond the opposite ends of the inner strips 76 are employed to attach, such as by stitching 82 or any other suitable means, the first and second divider members 62, 64 to the first and second spaced portions 70A, 70B of the open end of the bag or of the round member 70.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

What is claimed is:

1. A method of assembling a golf club organizing assembly for use in receiving golf clubs in a carrying bag, comprising the steps of:

(a) providing first and second pluralities of divider members, each divider member having a pair of opposite ends and opposite spaced upper and lower longitudinal edges, the divider members also having apertures defined through portions of the divider members located between the upper and lower longitudinal edges thereof; and (b) interfitting the divider members of the first and second pluralities with one another in an intersecting relationship at the apertures in the portions thereof so as to form a plurality of slots for receiving shafts of golf clubs placed in the carrying bag;

(c) wherein said providing each of said divider members of said first and second pluralities includes (i) providing an elongated inner strip of a material being sufficiently semi-rigid and semi-flexible to retain its shape, (ii) enclosing said inner strip with an elongated outer protective covering strip of a flexible material, and (iii) extending said apertures through said inner strips and outer protective covering strips of said respective divider members of said first and second pluralities.

2. The method of claim 1 further comprising the steps of:

extending said divider members of said first and second pluralities between respective first and second spaced portions of an open upper end of the carrying bag; and interconnecting said opposite ends of said divider members of said first and second pluralities to said respective first and second spaced portions of the open end of the carrying bag.

3. The method of claim 2 wherein:

said divider members of said first plurality are interconnected between said first spaced portions of the open end of the carrying bag so as to have substantially straight configurations; and said divider members of said second plurality are interconnected between said second spaced portions of said open end of the carrying bag so as to have substantially curved configurations.

4. The method of claim 1 further comprising the steps of:

extending said divider members of said first and second pluralities between respective first and second spaced portions of an open upper end of the carrying bag; and interconnecting said opposite ends of said divider members of said first plurality to said first spaced portions of the open upper end of the carrying bag and said opposite ends of said divider members of said second plurality to said second spaced portions of the open upper end of the carrying bag by attaching thereto at said respective first and second spaced portions thereof opposite end portions of said outer covering strips of said divider members which extend beyond opposite ends of said inner strips of said divider members.

5. The method of claim 1 further comprising the steps of:

providing a round member encircling a space and having first spaced portions and second spaced portions and being attachable to an open upper end of a golf club carrying bag;

extending said divider members of said first plurality between said first spaced portions of said round member and said divider members of said second plurality between said second spaced portions of said round member; and interconnecting said opposite ends of said divider members of said first plurality to said first spaced portions of said round member and said opposite ends of said divider members of said second plurality to said second spaced portions of said round member by attaching to said round member at said respective first and second spaced portions thereof opposite end portions of said outer covering strips of said divider members which extend beyond opposite ends of said inner strips of said divider members.

6. The method of claim 5 wherein:

said divider members of said first plurality are interconnected between said first spaced portions of said round member so as to have substantially straight configurations; and said divider members of said second plurality are interconnected between said second spaced portions of said round member so as to have substantially curved configurations.

7. A method of assembling a golf club organizing assembly for use in receiving golf clubs in a carrying bag, comprising the steps of:

(a) providing first and second pluralities of divider members, each divider member having a pair of opposite ends and opposite spaced upper and lower longitudinal edges, the divider members also having apertures defined through portions of the divider members located between the upper and lower longitudinal edges thereof; and (b) interfitting the divider members of the first and second pluralities with one another in an intersecting relationship at the apertures in the portions thereof so as to form a plurality of slots for receiving shafts of golf clubs placed in the carrying bag;

(c) wherein said apertures include a plurality of slits defined through said divider members of said first plurality, said slits being spaced longitudinally between said opposite ends of said divider members of said first plurality such that said divider members of said second plurality interfit with said divider members of said first plurality by extending through said slits therein.

8. The method of claim 7 wherein said slits in said divider members of said first plurality have opposite upper and lower ends respectively inwardly spaced from said upper and lower longitudinal edges of said divider members of said first plurality so as to leave upper and lower portions of said divider members of said first plurality extending between said upper and lower longitudinal edges of said divider members of said first plurality and said upper and lower ends of said slits.

9. The method of claim 8 wherein said apertures includes a plurality of notches defined through said divider members of said second plurality, said notches being spaced longitudinally between said opposite ends of said divider members of said second plurality and extending from one of said upper and lower longitudinal edges of said divider members of said second plurality to inner ends terminating in spaced relationship from said other of said upper and lower longitudinal edges of said divider members of said second plurality so as to leave portions of said divider members of said second plurality extending between said inner ends of said notches and said other of said upper and lower longitudinal edges of said divider members of said second plurality.

10. The method of claim 9 wherein said interfitting of said divider members with one another includes interlocking said divider members of said second plurality with said divider members of said first plurality by receiving in said notches in said divider members of said second plurality corresponding ones of said upper and lower portions of said divider members of said first plurality extending between said upper and lower longitudinal edges of said divider members of said first plurality and said opposite upper and lower ends of said slits.

11. The method of claim 10 wherein said providing each of said divider members of said first and second pluralities includes:

providing an elongated inner strip of a material being sufficiently semi-rigid and semi-flexible to retain its shape;

enclosing said inner strip with an elongated outer protective covering strip of a flexible material; and extending said slits and notches through respective ones of said inner strips and outer protective covering strips of said respective divider members of said first and second pluralities.

12. The method of claim 11 further comprising the steps of:

providing a round member encircling a space and having first spaced portions and second spaced portions and being attachable to an open upper end of a golf club carrying bag;

extending said divider members of said first plurality between said first spaced portions of said round member and said divider members of said second plurality between said second spaced portions of said round member; and interconnecting said opposite ends of said divider members of said first plurality to said first spaced portions of said round member and said opposite ends of said divider members of said second plurality to said second spaced portions of said round member by attaching to said round member at said respective first and second spaced portions thereof opposite end portions of said outer covering strips of said divider members which extend beyond opposite ends of said inner strips of said divider members.

13. The method of claim 11 further comprising the steps of:

extending said divider members of said first and second pluralities between respective first and second spaced portions of an open upper end of the golf club carrying bag; and interconnecting said opposite ends of said divider members of said first plurality to said first spaced portions of the open upper end of the carrying bag and said opposite ends of said divider members of said second plurality to said second spaced portions of the open upper end of the carrying bag by attaching thereto at said respective first and second spaced portions thereof opposite end portions of said outer covering strips of said divider members which extend beyond opposite ends of said inner strips of said divider members.

* * * * *